US011052423B2

(12) United States Patent
Zuger

(10) Patent No.: US 11,052,423 B2
(45) Date of Patent: Jul. 6, 2021

(54) HEAT-LIGHT SEPARATION FOR A UV RADIATION SOURCE

(71) Applicant: Oerlikon Surface Solutions AG, Trubbach, Trubbach (CH)

(72) Inventor: Othmar Zuger, Triesen (LI)

(73) Assignee: OERLIKON SURFACE SOLUTIONS AG, PFÄFFIKON, Pfäffikon SZ (CH)

( * ) Notice: Subject to any disclaimer, the term of this patent is extended or adjusted under 35 U.S.C. 154(b) by 0 days.

(21) Appl. No.: 14/902,052

(22) PCT Filed: Jun. 30, 2014

(86) PCT No.: PCT/EP2014/001779
§ 371 (c)(1),
(2) Date: Dec. 30, 2015

(87) PCT Pub. No.: WO2015/000574
PCT Pub. Date: Jan. 8, 2015

(65) Prior Publication Data

US 2016/0368021 A1 Dec. 22, 2016

Related U.S. Application Data

(60) Provisional application No. 61/842,576, filed on Jul. 3, 2013.

(30) Foreign Application Priority Data

Jul. 3, 2013 (DE) ..... 10 2013 011 066.1

(51) Int. Cl.
*B05D 3/06* (2006.01)
*F26B 3/28* (2006.01)

(52) U.S. Cl.
CPC ..... *B05D 3/067* (2013.01); *F26B 3/28* (2013.01)

(58) Field of Classification Search
CPC ..... B05D 3/061; B05D 3/067; F26B 3/28
See application file for complete search history.

(56) References Cited

U.S. PATENT DOCUMENTS 2,140,069 A * 12/1938 Bostwick ..... A45D 42/00 359/854
3,171,403 A * 3/1965 Drescher ..... F24S 50/20 126/603

(Continued)

FOREIGN PATENT DOCUMENTS

DE 103 52 184 A1 6/2005
FR 2 629 187 A1 9/1989

OTHER PUBLICATIONS

International Search Report for PCT/EP2014/001779 dated Sep. 3, 2014.

*Primary Examiner* — Sean M Luck
(74) *Attorney, Agent, or Firm* — Pearne & Gordon LLP

(57) ABSTRACT

A device for applying UV radiation to substrates in a field of application. The device includes: a radiation source, which emits both UV radiation and visible light and infrared radiation in a spatial angle; and a radiation-selective deflecting mirror, which mostly reflects the UV radiation and mostly transmits the VIS and IR radiation. The deflecting mirror includes at least two flat mirror strips, which are tilted with respect to each other.

13 Claims, 6 Drawing Sheets

(56) References Cited

U.S. PATENT DOCUMENTS 3,712,980 A * 1/1973 Norton ..... C03C 17/36 362/260
4,048,490 A * 9/1977 Troue ..... F21V 9/04 362/263
4,146,308 A * 3/1979 Cohen ..... G02B 7/182 248/472
4,277,141 A * 7/1981 Kleiber ..... B29C 39/10 156/285
4,298,806 A * 11/1981 Herold ..... A61C 19/004 250/472.1
4,408,595 A * 10/1983 Broyles ..... F24S 30/452 126/570
4,487,479 A * 12/1984 Tolomeo, Sr. ..... G02B 7/1824 359/854
4,602,321 A * 7/1986 Bornhorst ..... F21V 9/40 362/268
4,643,544 A * 2/1987 Loughran ..... B60R 1/081 359/854
4,644,899 A 2/1987 Glaus
4,775,231 A * 10/1988 Granzow ..... A47G 1/04 359/854
4,864,145 A * 9/1989 Burgio, Jr. ..... B41F 23/0409 250/492.1
4,974,136 A * 11/1990 Noori-Shad ..... F21S 10/02 359/885
4,990,789 A * 2/1991 Uesaki ..... H05B 6/64 250/493.1
D370,129 S * 5/1996 Freudenfeld ..... D6/301
5,587,626 A * 12/1996 Parham ..... H01J 9/20 313/634
5,742,066 A * 4/1998 Cavestri ..... G01J 1/08 250/504 R
5,808,763 A * 9/1998 Duck ..... G02B 6/29362 398/79
5,862,162 A * 1/1999 Maeda ..... H01S 5/141 372/100
5,932,886 A * 8/1999 Arai ..... B01J 19/123 250/504 R
5,967,648 A * 10/1999 Barnes, II ..... F21S 8/06 362/223
6,053,409 A * 4/2000 Brobst ..... G02B 5/09 235/462.06
6,124,600 A * 9/2000 Moroishi ..... F21V 13/08 250/492.1
6,621,087 B1 * 9/2003 Bisges ..... F21V 7/005 250/492.1
6,962,421 B2 * 11/2005 Yang ..... A47G 1/04 132/316
7,068,332 B2 * 6/2006 Liu ..... G02F 1/133611 349/161
7,128,429 B2 * 10/2006 Tausch ..... F26B 3/28 359/614
7,535,563 B1 * 5/2009 Chen ..... G01N 21/4788 356/237.1
8,233,218 B1 * 7/2012 Mossberg ..... A44C 15/00 359/567
2002/0131180 A1 * 9/2002 Goodman ..... G02B 6/29367 359/634
2003/0035972 A1 * 2/2003 Hanson ..... B32B 7/02 428/480
2004/0130723 A1 * 7/2004 Yager ..... G01N 21/553 356/445
2004/0147986 A1 * 7/2004 Baumgardner ..... A61N 5/0616 607/94
2005/0134983 A1 * 6/2005 Lynam ..... B60R 1/12 359/872
2005/0153126 A1 * 7/2005 Finley ..... B65G 49/069 428/336
2005/0195488 A1 * 9/2005 McCabe ..... B60R 1/088 359/603
2006/0050523 A1 * 3/2006 Schmidt ..... B60Q 1/14 362/510
2006/0232978 A1 * 10/2006 Lang ..... H01J 61/025 362/341
2006/0292311 A1 12/2006 Kilburn
2008/0002180 A1 * 1/2008 Gigioli ..... G01J 3/02 356/51
2008/0137172 A1 * 6/2008 Staker ..... G02B 6/357 359/291
2008/0151364 A1 * 6/2008 Shafer ..... G02B 17/0812 359/365
2008/0230721 A1 * 9/2008 Matsushita ..... H01L 21/6715 250/492.2
2009/0040586 A1 * 2/2009 Kim ..... G02B 26/0841 359/223.1
2009/0059170 A1 * 3/2009 Sander ..... G02B 21/18 351/216
2009/0237783 A1 * 9/2009 Kim ..... G02B 23/02 359/407
2009/0303571 A1 * 12/2009 Sandstrom ..... G02B 5/1809 359/291
2010/0060987 A1 * 3/2010 Witzman ..... G02B 5/286 359/589
2010/0192941 A1 * 8/2010 Stoia ..... H01L 31/0547 126/574
2010/0195227 A1 * 8/2010 Green ..... G02B 7/1827 359/853
2010/0242953 A1 * 9/2010 Bhandari ..... C03B 23/0357 126/684
2010/0263709 A1 * 10/2010 Norman ..... H01L 31/0547 136/246
2010/0302535 A1 * 12/2010 Lipson ..... G01J 3/02 356/301
2011/0002028 A1 * 1/2011 Luten ..... B60R 1/00 359/267
2011/0079215 A1 * 4/2011 Xiang ..... F24S 23/77 126/600
2011/0117678 A1 * 5/2011 Varadarajan ..... H01L 21/3105 438/4
2011/0203578 A1 * 8/2011 Thiel ..... F24S 23/79 126/684
2011/0303214 A1 * 12/2011 Welle ..... F24S 60/00 126/578
2012/0099307 A1 * 4/2012 Richardson ..... F21S 10/02 362/231

* cited by examiner

FIGURE 5
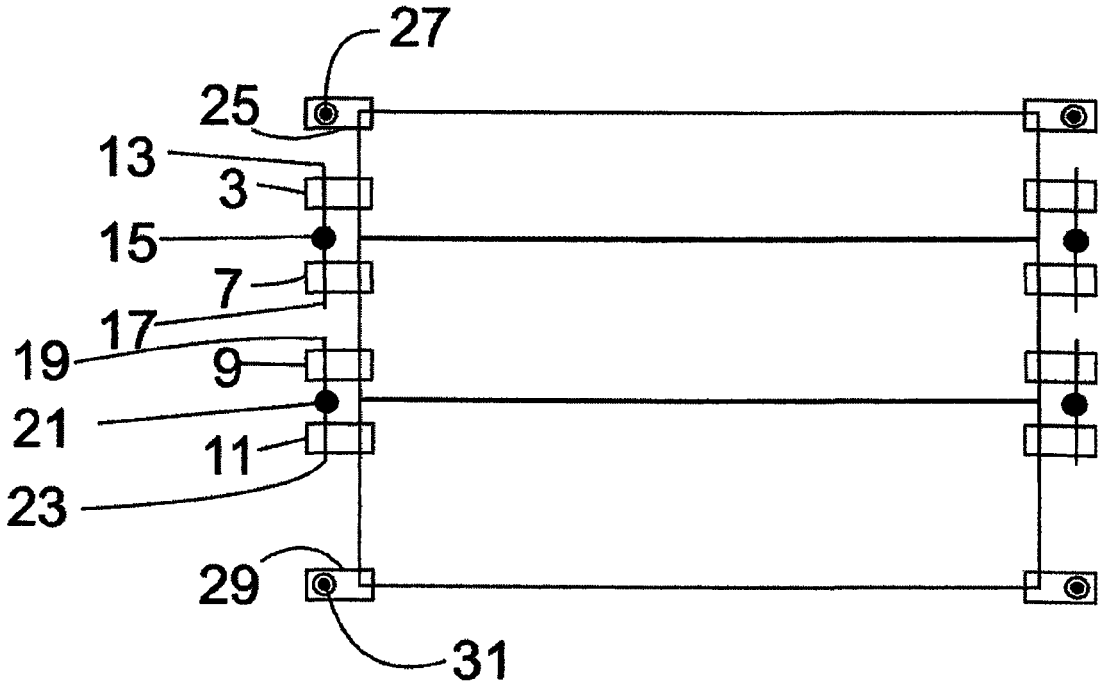
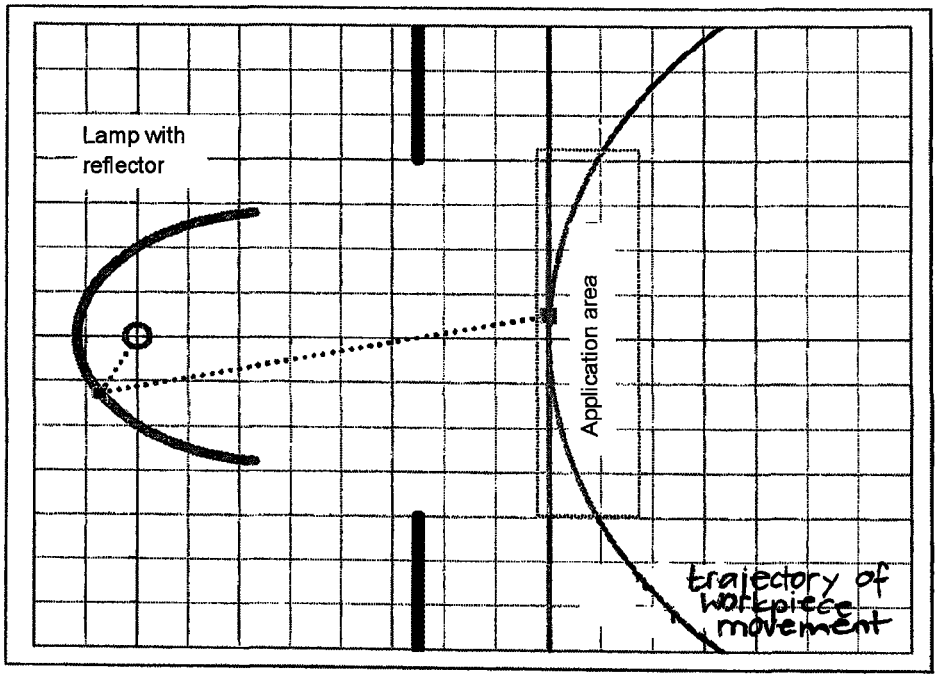
FIGURE 6A

FIGURE 8
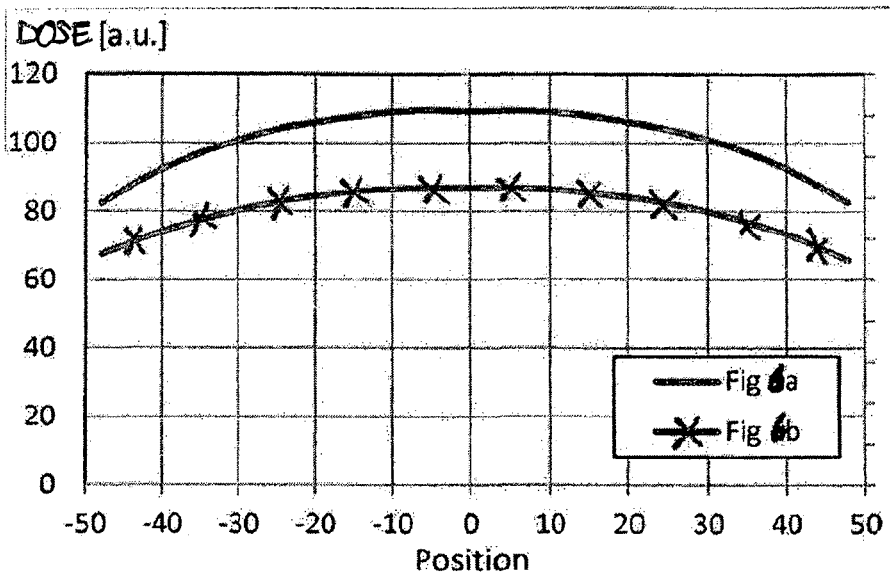
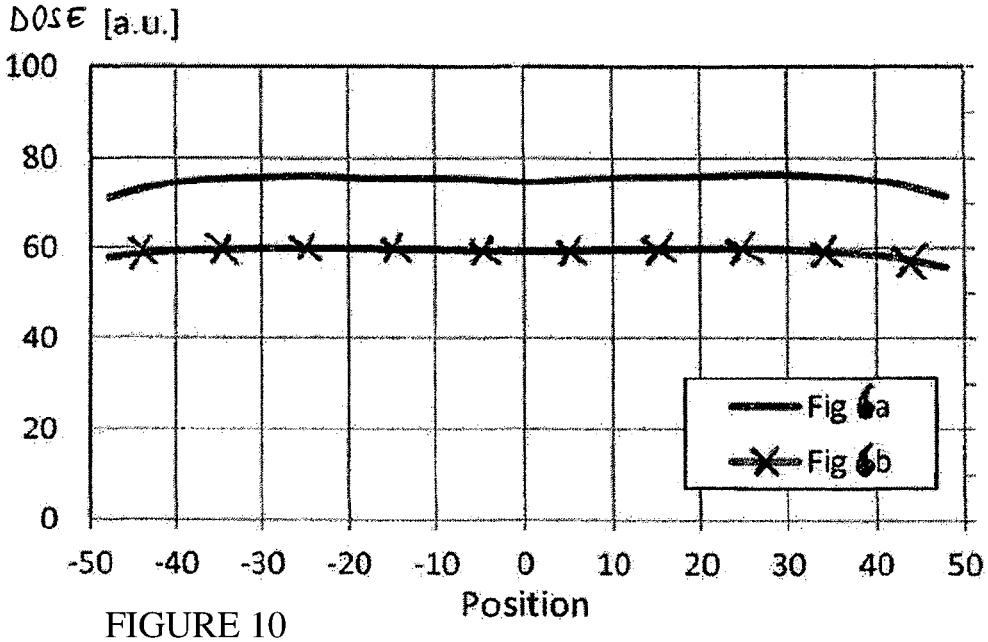
FIGURE 10

HEAT-LIGHT SEPARATION FOR A UV RADIATION SOURCE

The present invention is directed to a radiation apparatus according to the generic part of claim 1.

UV-hardenable lacquers are used in a multitude of different areas. Hardening is to be understood substantially as the crosslinking of Polymer chains. AT UV-hardening lacquers this crosslinking is induced by UV radiation.

Normally, these lacquers comprise when applied to a workpiece solvents which have to be expelled prior to hardening. This expelling may be accelerated by an increase of the temperature over ambient temperature. The higher the temperature is the faster the solvents are expelled. Thereby, nevertheless, a certain temperature, which is dependent from the lacquer (glass temperature, chemical decomposition temperature), should not be exceeded. Likewise, the deformation temperature of the material of the workpiece is not to be exceeded.

Highly intensive UV radiation sources are based on gas discharge lamps which emit, beside of the desired UV radiation also strong visible light (VIS) and infrared radiation (IR). VIS and IR contribute to a substantial additional temperature rise during hardening of lacquers. Thereby one must avoid that the temperature rises during the hardening process above the glass temperature of the lacquer. It is desirable to oppress this VIS and IR contribution as far as possible, thereby loosing as few as possible UV radiation.

Typical UV radiation sources consist of a gas discharge lamp and a reflector element which collects UV radiation emitted in a direction away from the workpiece and reflects it in direction of the application-area. The UV radiation which is propagating towards the application-area is thus composed from direct radiation and from reflected radiation. In the case of a substantially linear source, the lamp is substantially tube shaped. The lamp may also consist of a series of single substantially punctual lamps which are arranged in a row.

So as to attenuate the undesired VIS and IR component of the emitted radiation of the lamp which impinges on the application-area, the reflector element may be provided with a coating which reflects the VIS and IR radiation to a less possible extend. This may be realized by an absorbing layer, but is preferably realized as a dichroic thin film coating which, on one hand, highly reflects the UV component and transmits VIS and IR, which means deflects it from the application-area. An UV source, which is tailored this way, reduces the VIS and IR radiation in the application-area according to the reflecting element (typically an elliptic element in cylindrical shape) by a factor in the range of 2-5.

In this manner, nevertheless, there occurs no attenuation of the VIS and/or IR component of the direct radiation. Additionally, a substantial remaining portion of the VIS and IR radiation impinges on the application-area which portion is hot transmitted by the coating of the reflector.

A further attenuation of the VIS and IR radiation may be realized by means of an additional deflecting mirror in the optical path of the direct radiation. Such a deflecting mirror should reflect UV radiation as well as possible, should reflect the VIS and IR radiation to a smallest possible degree. Such a deflecting mirror is realized as a flat mirror. Most common there is used a glass plate with a dichroic thin film filter coating which is arranged in an angle of 45° with respect to the main beam of the UV source. The application-area is arranged downstream in the optical path of the UV radiation reflected by the deflecting mirror.

The UV radiation is deflected by such deflecting mirror by 90° whereas the VIS & IR radiation is transmitted and thus not led towards the application-area.

Dependent from the reflector element and from the deflecting mirror attenuations of the VIS & IR radiation by factors of 10-20 are realized. Without deflecting mirror, as was addressed above, only attenuation factors of between 2 and 5 are reached. Whereas, by means of the reflector element of the lamp, typically over 80% of the UV radiation may be collected, nevertheless, with the addition deflecting mirror and dependent on its realization form and geometric arrangement, typically 30-50% of the UV radiation gets lost up to the application-area. Therefrom, there results a ratio of light power of UV/(VIS & IR) in the range of over 10:1 of the relative components with a typically used mercury medium pressure gas discharge lamp. On the other hand and without a deflecting mirror this ratio is typically only 2:1 to 4:1. This reduced UV radiation with the deflecting mirror could, if available, be compensated by a stronger UV lamp without raising the VIS & IR radiation components supererogatory. The inevitable cooling of the lamp for intensive UV sources nevertheless sets technically and economically limits to increasing the power; these may lead in practice to increased distances to the UV source which again reduces the desired UV radiation intensity in the application-area.

Nevertheless, the use of the dichroic deflecting mirror leads to lengthening of the light path between the UV source and the application-area typically by approx. 70% of the length of the deflecting mirror.

The respective situation is shown in FIG. 1 with respect to the reflector radiation and in FIG. 2 with respect to the direct radiation. In the figures the UV radiation is shown by point-dotted line whereas the radiation of VIS & IR is shown by broken line. The total radiation is shown by continuous line.

Thereby, it becomes evident from FIG. 2 that a major part of the reflected UV radiation does not propagate to the application-area which is hatched in the figures.

Lengthening of the optical path has thus especially for the direct radiation the consequence, that, due to the aperture angle in which radiation is emitted, the intensity of the UV radiation per surface unit (surface intensity) is reduced especially also in the application-area. For hardening a lacquer layer a certain dose is necessary, which is given by the product of radiation intensity and exposure time (more accurate by the time integral of the intensity). The reduced surface intensity as addressed above may only be compensated by lengthening the exposure time so as to reach the required dose. This leads to lengthened processing time and thus to increased processing costs.

The reduced surface intensity as addressed above may nevertheless have an additional serious disadvantage: common UV hardening lacquers have a non-linear hardening characteristic with respect to the surface intensity. This means that the hardening degree is not only proportional to the exposure dose but diminishes below a certain threshold over-proportionally with decreasing surface intensity. At a too small surface intensity no complete hardening can result.

The reduced surface intensity may partially be compensated in that a configuration of the reflector element is selected so, that the light is led onto the application-area in an approximately collimated or even partially focused manner. In the case of non-flat workpieces with inclined side faces or recesses, this leads to the disadvantage that these areas are exposed to substantially less UV light. By increased exposure, the required exposure dose can possibly be reached if the resulting over-exposure of the flat areas doesn't lead to disadvantages and the minimally necessitated intensity may nevertheless be reached. If this is not the case, there exists the possibility to rotate the workpieces during the relative movement of the workpieces with respect to the UV source. This additional movement nevertheless leads to significant additional expenditure for the support of the workpieces and for the facilities for the movement and to the disadvantages of a reduced arrangement density of workpieces in the hardening plant and to a substantial lengthening of the exposure times.

These disadvantages coupled to the use of the deflecting mirror may again be bypassed by UV sources of higher power. Beside of the higher costs for a stronger UV source, also the waste heat, which has to be removed, has to be considered. When using high UV radiation powers as used in manufacturing appliances, increased system temperatures lead on one hand to processing drifts and on the other hand to accelerated aging defects of the apparatus and facilities. They may normally be reduced with the help of additional cooling means or may be even eliminated, which nevertheless is coupled to additional investments and operating costs.

The inventor has found, that the drawbacks addressed above may be strongly reduced by a deflecting mirror with a substantially concave surface shape. Thereby and with the curvature not only the lengthened optical part may be easily compensated but additionally, at least in a plane, a partial focusing of the reflected UV radiation may be achieved, which leads to an increase of the surface intensity. The shape of the bent deflecting mirror is thereby dependent from the exact position and orientation of the application-area.

The substrate of the bent deflecting mirror is thereby preferably permeable for VIS & IR radiation. As a substrate material, i.e. glass and plastic material, come thus into consideration whereby one should keep in mind that the substrate is exposed to high temperatures and to a remaining UV radiation. Nevertheless, it would also be possible to select for the substrate a material, which absorbs VIS & IR efficiently, but it would be strongly heated up by the absorbed power and would have to be separately cooled.

So as to realize the optical characteristics as required a concavely bent glass surface may be coated with an interference filter. The interference filter is, as an example, built up as a thin film alternate layer system, whereby the layers closer to the surface provide for the reflection of the UV radiation and the alternate layer system as a whole, acts as anti-reflex layer for the VIS & IR radiation. The problems occurring in the frame of manufacturing of the bent glass surface may only be resolved under high expenditures. Further, the angle dependency of the optical behavior of the interference filers is a challenge. On one hand, the difficulty occurs when coating bent surfaces to reach a uniform coating along the entire optically relevant surface. On the other hand, this approach necessitates, for an optimum functioning so-called gradient filters, so as to cope with the different position dependent impinging angles. The coating technology available is nevertheless able to at least partially master these problems also such mastering being associated with large expenditures and thus again with high costs.

In the approach with the bent mirror the problem accrues that in some applications the distance from the radiation source to the application-area of the radiation basis. This may for an instance be the cases when, on one hand, large substrates provided with a lacquer layer shall be exposed to TV radiation, which are disposed in a plane and when, with the same hardening apparatus also small substrates positioned on a spindle, shall be exposed to UV radiation, whereby and due to the spindle, the substrates and thus the application-area are disposed closer to the deflecting mirror. In the worst case it becomes necessary to exchange the bent deflecting mirror by a deflecting mirror with a different curvature.

There is thus a need for a radiation apparatus for UV radiation which is simple to be realized but which is efficient and by which there is reached, that an application-area is exposed to UV radiation with a sufficient surface intensity.

According to the invention, this object is resolved according to a preferred form of realization in that there is applied a deflecting mirror, which is composed from plane mirror strips, whereby the plane mirror strips are mutually inclined in a manner, that they at least roughly imitate a desired curvature. At least two strips are used, nevertheless and preferably more than two and especially preferred three strips.

Thereby, the two dominant disadvantages of the bent shape may be bypassed in a simple way. The coating of the mirror strips may be done so that first flat glass is coated. A glass plate coated in this manner is subsequently dissected in strips and these strips are mounted in a holding member. This holding member is tailored so that each of the mirror strips becomes oriented at a pre-determined angle to the main optical path of the UV source. The single angles are selected so, that most possible UV radiation impinges on the application-area. Due to the fact that the mirror strips substantially transmit the VIS & IR radiation, this component remains in any case small in the application-area.

With suited individual selection of the spectral characteristics of the thin film mirror layer for each mirror strip, both requirements may be even further optimized. Thus, for each angle a specific glass plate is coated with a thin film interference filter optimized for this specific angle. The deflecting mirror according to the invention is then composed from strips of the differently coated glass plates.

According to an especially preferred form of realization of the present invention, the fixations by which the mirror strips are fixed to the support, are tailored so, that they may be twisted, at least in a certain angle range, about an axis which is parallel to the longer edge of the mirror strips. Thereby, it becomes possible to adjust for the approximated bent of the deflecting mirror and thereby to optimize the UV radiation power for different application planes.

By means of adjustable angles of the mirror segments, the exposure of the different surface elements of 3-dimensional workpieces with intrusions and side faces may be made substantially more uniform and thus improved, in that the segments are so adjusted, that the light impinges with parts of the beam upon the application-area in a focused manner over a large angular range. Although their results for the flat areas a somehow lower intensity, there is thereby reached a homogeneous exposure over the entire surface of the workpiece. This form of realization allows a simple and especially flexible adjustment of the angular distribution and of the special distribution of the radiation light. The adjustment of the angles of these mirror segments may be also realized via externally controllable drives which opens the possibility to optimally perform the exposure on differently shaped elements controlled by the process. In a further refinement the mirrors may be moved synchronously with the passing movement of the workpieces through the application-area by drives tailored as addressed.

In this manner the exposure of the surface shape of the workpieces may be done in a dynamically adapted and optimized manner.

The invention is now exemplified in detail with the help of figures.

Figure 4:
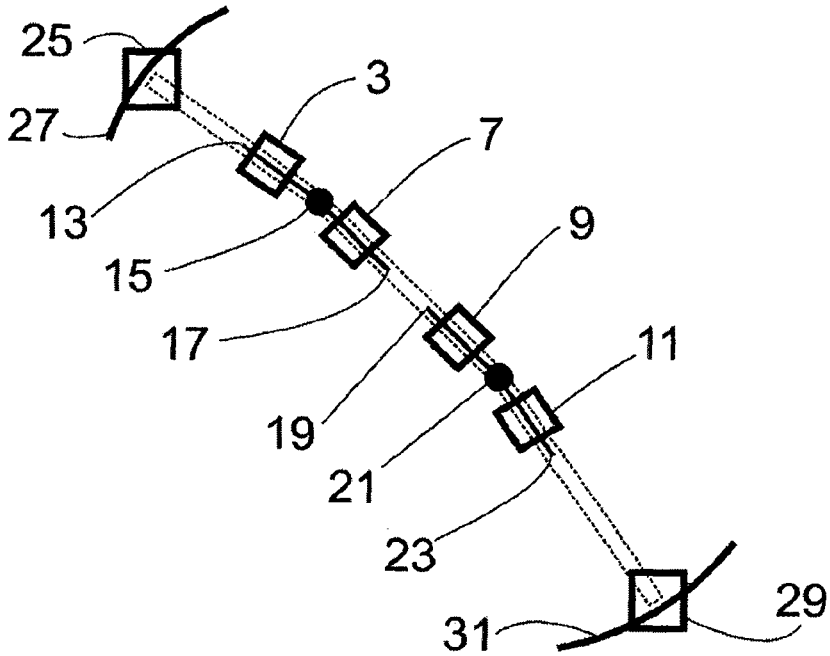
FIG. 4 shows an example of a support for a deflecting mirror according to the invention.

In FIG. 5 there is shown an according top view of the support shown in FIG. 4.

FIG. 6*a* shows a hardening unit.

Figure 6B:
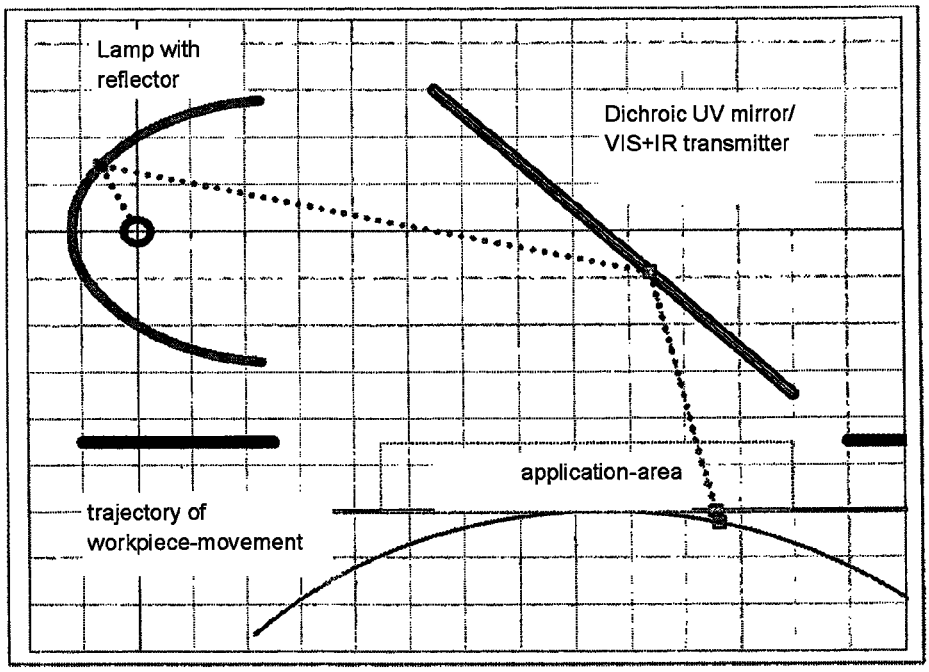

FIG. 6*b* shows a hardening unit as well.

Figure 7:
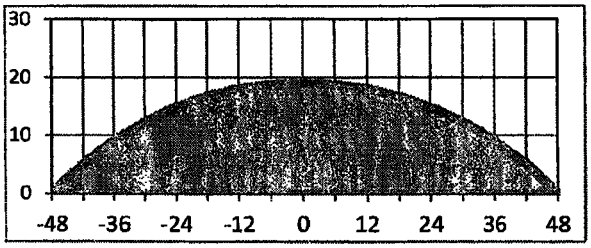

FIG. 7 shows a workpiece to be treated the cross-section of which representing a segment of a circle.

FIG. 8 shows the position dependent profile of the dose.

Figure 9:
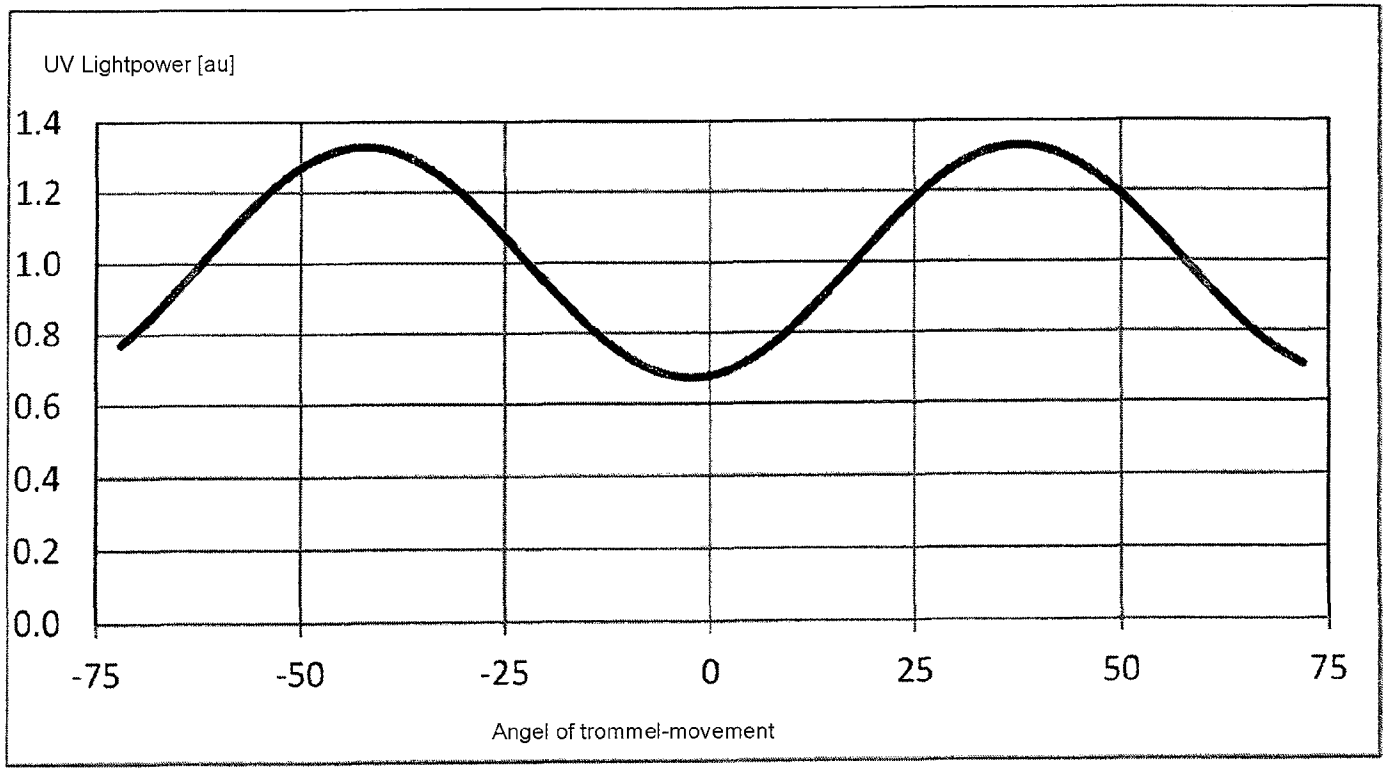

FIG. 9 shows the variation of the power of the UV source synchronously with the movement of the workpiece.

FIG. 10 shows the result for the local distribution of the UV radiation dose on the surface of the assumed workpieces, respectively for the configurations according to FIG. 6*a* and to FIG. 6*b*.

In reality the substrates are often moved through the application area. As an example along a circular path if applied on a so-called spindle. Thereby, a repetitive exposure of the lacquer is achieved. With this movement the undesired temperature increase is additionally reduced because the surface may cool down during the angular area of the circular movement which is averted from the application-area.

In the following a quantitative comparison of the cumulated UV dose (=intensity×time) on a flat substrate which is moved through the application-area, whereby it is referenced to the case without the dichroic mirror, for which a dose=100 is assumed. The dichroic mirror has in the presently assumed case a reflection coefficient of approx. 93% for the UV radiation and a transmission coefficient of approx. 92% for the VIS & IR radiation. For the UV dose in the application-area there results a value of approx. 65, for the VIS and IR dose a value of approx. 25, which means that the undesired radiation is reduced by the flat dichroic mirror by 75% whereas the desired UV radiation is only reduced by 30%.

Now if one switches from the flat deflecting mirror to two mutually inclined mirror strips, there results a substantially higher UV doses of 79, (compared with 65 for the flat deflecting mirror). In opposition thereto the VIS & IR doses increases only little on 28 (compared to 25 for the flat deflecting mirror).

Figure 1:
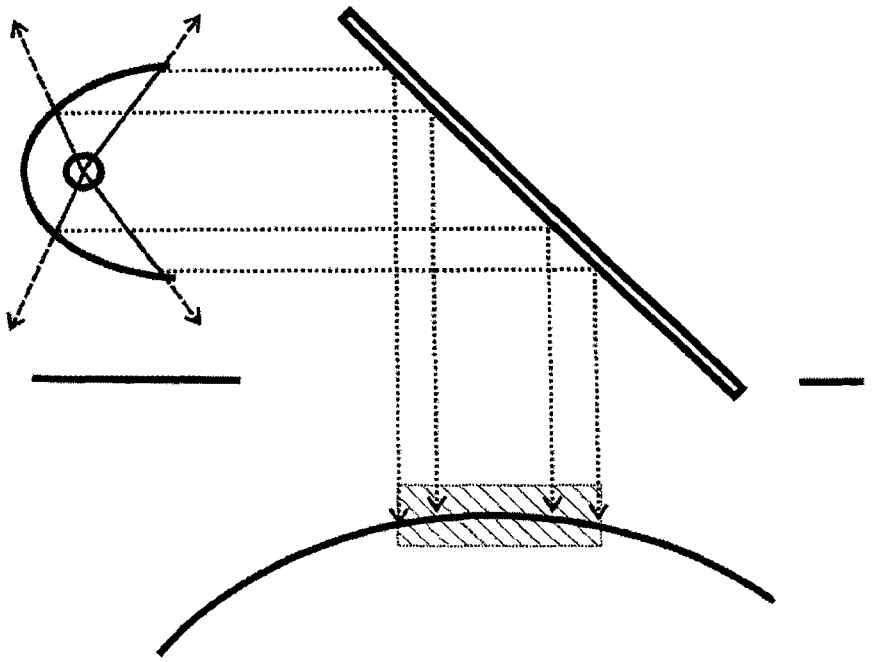
FIG. 1 shows a UV radiation apparatus with a planar deflecting mirror and the optical path of the reflector radiation.
Figure 2:
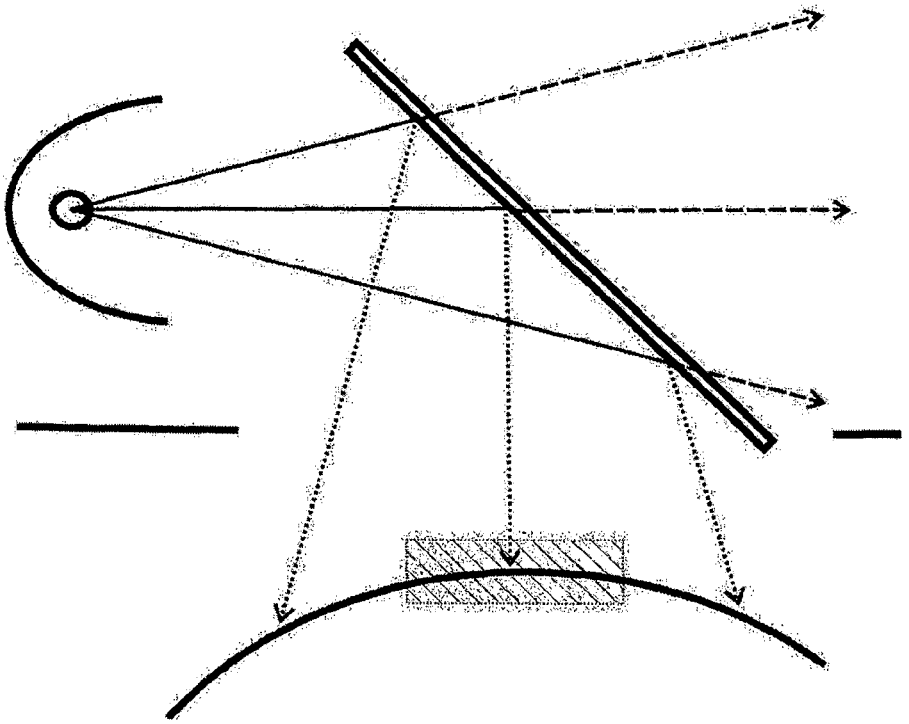
FIG. 2 shows the radiation apparatus according to FIG. 1 and the optical path for the direct radiation.
Figure 3:
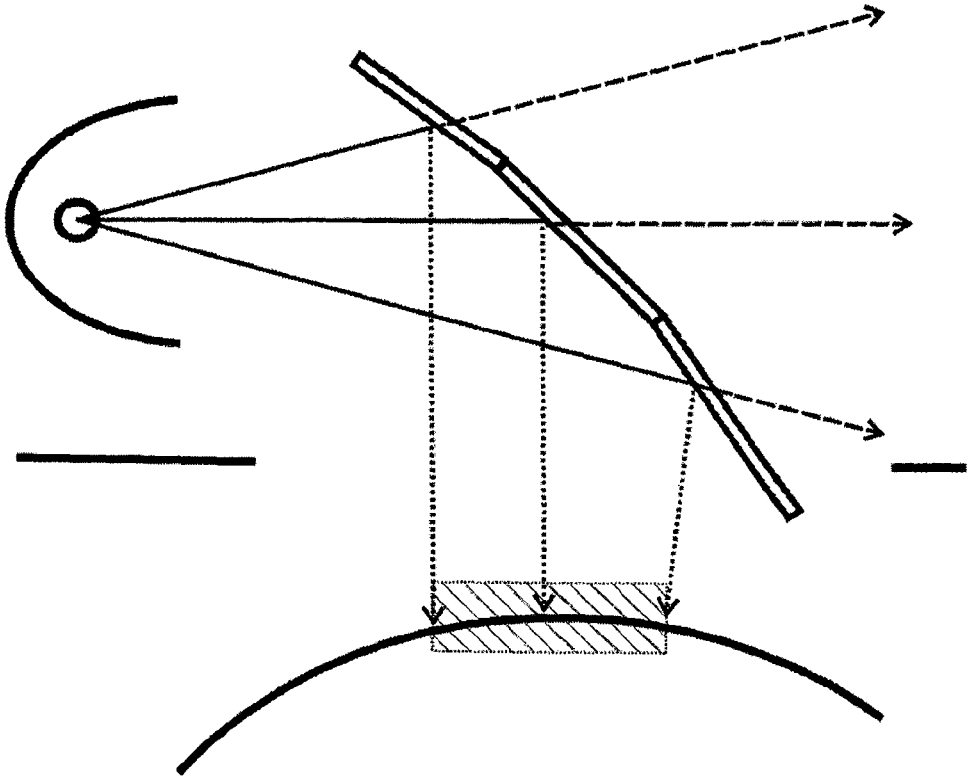
FIG. 3 shows a radiation apparatus according to a preferred form of realization of the present invention whereby the deflecting mirror is realized by three mirror strips.

With a further splitting of the deflecting mirror in three strips, as shown in FIG. 3 the UV dose in the application-area may additionally be improved. For this case schematically shown in FIG. 2, there results a UV dose of 83, i.e. an increase by 30% with respect to the flat deflecting mirror, whereas the VIS & IR dose increases only to approx. 29.

With an increasing number of mirror segments the efficiency for the UV light guidance onto the application-area may theoretically be further improved. Nevertheless, also the number of strip-edges increases at which losses occur. Additionally, the expenditure for manufacturing such a multi-segment mirror increases.

Beside of the dose of UV radiation which is important for UV hardening, for some hardening processes a threshold of intensity of the UV radiation must be exceeded for a certain time span. Whereas for the case of the flat deflecting mirror for the addressed example, an intensity maximum of approx. 45 units is reached, for the case in which the deflecting mirror consists of two mirror strips there is reached a value of approx. 60 and in the case shown in FIG. 3 with three strips even a value of approx. 80. Thus, with the split of the dichroic mirror in strips almost the same surface intensity may be reached as in the case of an approach without this mirror.

At a non-linear relation of hardening and dose reaching of the threshold for this surface intensity may still be made sure.

By means of the present invention there is reached a significant increase of the desired UV radiation intensity in the application-area without having to accept a significant increase of the undesired VIS and IR radiation intensity. Consequently, the hardening step of UV sensitive lacquer may be done in shorter time and thus with an increased tact rate, more workpieces may be hardened per time unit. Alternatively one can reach an equivalent result with a weaker UV light source with the advantage of lower purchase price of a weaker UV light source and of lower costs of operation. Further, a higher efficiency of the UV light guidance onto the application-area has the advantage, that required coolings of the apparatus and especially of the application-area, in which the substrates with the temperature sensitive lacquer reside, may be, on one hand, dimensioned smaller and with less expenditures and, on the other hand, may be operated with less energy consumption. In production technical plants the entire waste heat of the hardening process must be removed with a strong air cooling so as to keep the temperature increase in the application-area low. At such air streams one must prevent by means of intense filtering, that dust particles get into the stream and thus on the lacquer surface, which is at the beginning still in a viscous state, and sticks thereon. Any reduction of the air stream necessitated by reduction of undesired radiation or by improvement of efficiency of the UV light guidance, as shown in the invention, leads to a possible reduction of this required air streams.

With respect to an example of a deflecting mirror, which is built from three mirror strips, there is shown in FIG. 4 a support for the mirror strips. In the figure, the mirror strips in cross-section are only shown by dash line. The support comprises fixation elements 3, 7, 9 and 11, which are provided at the strips along the shorter edges, are, for example, clamped thereto. The fixation element 3 of a strip is thereby linked to the fixation element 7 of a neighboring strip via webs 13, 17 linked by a joint 15. The fixation element 9 of the central strip is thereby linked to the fixation element 11 of the other neighboring strip via webs 19, 23, linked by a joint 21. The outermost strips of the deflecting mirror have additional fixation elements 25 and 29. These fixation elements are fixed to circular arcs 27, 31. They may be shifted along these circular arcs and may then be fixated. The circular arc 27 belongs to a theoretical circle, the center of which being in the joint 15. Circular arc 31 belongs to a theoretical circle, the center of which being in the joint 21.

Preferably there is provided such a mount on both sides of the mirror strips arranged in this way. In FIG. 5 there is shown a respective top view. With this support the inclination of the mirror strips may be adjusted and trimmed in a simple manner.

A further aspect of the present invention addresses facilities and process for a controllable exposure of workpieces to UV light for hardening of UV sensitive surface lacquers. Especially this aspect addresses UV exposures facilities for hardening UV sensitive lacquer layers on surfaces with a focus on homogeneous exposure or on an exposure of the lacquer surface following a predetermined profile on a three-dimensional workpiece.

Surface lacquers are applied for different functions of surface tempering as for mechanical and chemical protective layers but also for function as of special decorative characteristics as of color or light reflection or light scattering. The lacquers as used are applied as a film by spray-, dip- or paint-processes on the workpieces to be coated and are subsequently brought to their final state with the desired characteristics by means of a hardening process. During the hardening step, energy is applied to the lacquer film so as to accelerate the hardening process. For conventional lacquers, thermic energy in the form of infrared radiation or with the help of a heated gas (air) is applied. With the help of suited ovens or of infrared radiators, the lacquer layer may evenly be hardened in a relatively simple manner also on complex surface geometries. The relatively long time span (typically between 10 . . . 100 mins) is a drawback of this hardening processes, which, particularly in a series production process, can make the logistics complex and susceptible for disturbances of the procedure. With an alternative class of lacquers, which are hardened under addition of UV light, these problems may widely be eliminated. Hardening is performed by exposing the lacquer films to high intensive UV light sources. Thereby, the hardening step may substantially be shortened in time, exposure duration of 1 . . . 10 mins are typical. An even exposure of the lacquer film to UV light is nevertheless a challenge, especially for complex surfaces and shapes. For 2-dimensional surfaces an even exposure in one dimension is reached by making use of a rod-shaped, linear UV source, evenness in other dimension may be reached by a relative movement of the workpiece with respect to the UV source. For more complex surface geometries, the workpiece must additionally be rotated and/or inclined relative to the UV source, which represents a special challenge with respect to the mechanics of the support of the workpiece in the hardening plant. This naturally limits the uniformity and evenness which are reachable of the characteristic and the quality features of the hardened films or limits the surface shapes which may be treated.

Significant film characteristics of the hardened lacquer film necessitate a minimal dose of UV light, variations with an overexposure may be small for these characteristics. Thus, a lack of UV light at some areas on the surface of the workpiece may be compensated by lengthened exposure duration whereby other areas become overexposed. For characteristics which are critically dependent from the dose a loss of homogeneity is the consequence.

A homogeneous exposure may be achieved by means of multiple rotating supports for the workpieces. Such supports and facilities therefore are expensive with respect to acquisition, are exigent with respect to handling and are normally inflexible with respect to application. Additional exploitation of the given maximum loading surface of the plant with workpieces is low.

Problems of the actual prior art may thus be:

Overexposure:

Characteristics are inhomogeneous, e.g. embrittlement in overexposed areas, in the area of incomplete hardening mechanically, less loadable film characteristics.

Multiple rotating supports for workpieces lead to a significant additional expenditure in manufacturing, preparing, handling and stock-keeping of workpiece-specific supports.

First, one must clarify how workpieces provided with the lacquer film are to be moved through an application-area into which UV light from a UV source is guided. An even exposure in the dimension perpendicular to the movement direction is realized by means of a longish shape of the illumination geometry (rod-shaped UV lamp). For the curvature shape of the movement of the workpieces we assume here a linear or circular movement on a cylinder without limiting the subsequently addressed method according to the invention thereon. FIG. 6*a* shows schematically the arrangement in a hardening unit with UV light source. The UV light of the UV lamp is collected via a reflector and is led onto an application-area in which the lacquer film on workpieces is exposed and is thus hardened. The workpieces in the application-area are heated up as the total light radiation of the UV source is absorbed to a large extend in this spacial area. The lacquer films are however temperature sensitive and the temperature is not allowed to exceed a maximum value. This problem is mitigated by a cyclic movement of the workpieces through the application-area, the workpieces may cool down during those time spans in which they are not located in the application-area. For workpieces with a limited extent, this cyclic movement is established preferably along a circular path in that the workpieces area mounted on a drum and this drum moves around its axis.

An advanced form of realization of a hardening unit is shown in FIG. 6*b*. By means of a dichroic mirror which is transparent for the VIS light and the IR radiation of the UV lamp but highly reflective for the UV, the unwanted VIS & IR radiation are led away from the application-area and consequently the temperature rise during the hardening process may be further limited.

In the following the method according to the invention of a homogeneous exposure of a workpiece having a more complex surface geometry and which is provided with a UV sensitive lacquer layer is shown. As an example, a cylindrical workpiece the cross-section of which representing a circle segment (FIG. 7) is described.

If this workpiece on a drum is conveyed in the a circular movement through the application-area, there results for the dose (=intensity×time) of the exposure with UV light, a position-dependent profile as shown in FIG. 8, respectively for a hardening unit according to the FIGS. 6*a* and 6*b*.

The dose decreases on the circular cylinder segment from the center toward the border of the workpiece by approx. 30%. According to the invention, the power of the UV source is non-varied synchronously with the movement of the workpiece. Thereby, the power is set to follow a determined curve shape over time. So as to illustrate the principle and for convenience, there is selected a sinusoidal curve shape whereby the phase is held in a constant relation to the rotational movement of the drum (FIG. 9).

The frequency of this modulation of the UV light power is given by the arrangement of the workpieces on the drum, whereby one departs from the fact that the spacing between the workpieces on the periphery of the drum is small in the sense of providing a dense loading. Thus, the modulation continues goes on with each of the workpieces which moves sequentially through the application-area.

In FIG. 10 the result of the local distribution of the UV radiation dose on the surface of the assumed workpieces is shown, respectively for the configurations of FIG. 6*a* and FIG. 6*b*. As shown from this diagram, the course of the dose from the center to the border becomes practically eliminated. This result is achieved in this case with a modulation amplitude of the UV light power of approx. 35' relative to the constant value. The phase of the modulation curve shape is selected so that the modulation power is minimal at the time when the workpiece assumes a minimal distance from the UV light source, i.e. the normal parallel to the axis of the UV light distribution.

The principle of this synchronous modulation of the light power with the movement of the workpiece may be applied according to the invention also on substantially more complex shapes then to that shape exemplified here. To do so, a substantially arbitrary periodic curve shape may be used which is, in a defined phase relation with respect to the substrate movement. The amplitude as well as the phase may each be modulated themselves under the constraint of a frequency which accords with the frequency of the workpiece movement over the application-area or which is a multiple of this frequency. The curve shape contains in this case higher harmonic components, each with a determined fixed phase so as to maintain synchronization with the workpiece movement.

The principle of the synchronous UV light power modulation for control of the UV dose on the lacquer film on workpiece surfaces which are arranged on a rotating drum may also be used to compensate for an inhomogeneous distribution of the dose along the circumference of the drum. Such an inhomogeneity may result from mechanical inaccuracies, errors in trimming, orientation errors, etc. Further an aberration from concentricity (i.e. not-constant speed of rotational angle) may lead to an inhomogeneous distribution of dose along the circumference.

By means of a modulation of the UV light power synchronously with the rotational movement of the drum the UV doses on the workpieces on the drum may specifically be influenced so that a more uniformed distribution of the dose results along the width-extent of the workpieces. In the case of non-concentricity the phase of the modulation has to be determined from the current values of a rotational angle sensor which is rigidly connected with the axis of the drum.

Influencing the UV dose along the width extent of the workpiece by means of the synchronous modulation of the UV light power is not limited on eliminating a non-uniformity of the TV dose but may specifically also be used to impose a determined wanted dose distribution along the workpiece so as to intensify or to attenuate a desired characteristic of the hardened lacquer film which may be influenced via the UV dose or the UV intensity on the surface of the workpiece. In the most-simple case, this may be set via the modulation amplitude and the modulation phase, assuming that the fundamental frequency of the modulation is pre-determined by the occupancy of the drum by workpieces and by the rotational speed of the drum. The modulation amplitude as well as the modulation phase may themselves be modulated synchronously, whereby the fundamental frequency has to accord with the movement frequency of the workpieces through the application-area.

With this principle it is even possible to provide different workpieces on the drum with an UV dose distribution optimized for the respective workpieces, in that for different rotational angles of the drum different modulation curve shapes are applied. Thereby, a substantially increased flexibility with respect to applicability may be reached.

A further advantage of this synchronous modulation may reside on the fact, that in a production environment, in which most different workpieces are to be exposed, substantially less different supports adapted for the respective workpieces may be necessary. By adapting the modulation curve shapes in the process recipe, courses of dose for different workpieces which are mounted on the same support may be equalized.

For more complex surface shapes of the workpieces it may be necessary that the support with the workpieces on the drum have to be rotated themselves about their axes, so as to realize also on the lateral faces a sufficiently high exposure dose. By means of the synchronous modulation of the UV light power, in those cases in which the lateral faces do not rise and drop down to steeply, one can realize an increase of the dose on these lateral faces also with non-rotating supports, which, on one hand, leads to a significant simplification of the plant equipment necessary (no rotational mechanism) and, on the other hand, the inevitable drop of throughput is eliminated, which results with rotating supports. In the case of rotating supports, normally substantially more parts may be held, but the exposure time lengthens to the same degree. By these additional mechanical equipment for support rotation nevertheless a part of the exploitable surface in the application space is lost which leads to the addressed loss in throughput.

In the description up to now we departed always from a drum on which the workpieces are mounted by means of supports and for this drum there was assumed a rotational movement about its axis. All explanations addressed above may also be applied in the case of a nonrecurring or cyclical movement of the workpieces on supports through the application-area of the UV exposure and thus, do also cover the case of an inline plant.

1. Resulting improvement compared with the prior art or, respectively, concrete advantages, which resulted from applying the invention.

- Improved uniformity of the characteristics and thus of the quality of a lacquer film on a workpiece
- Substantial increase of the flexibility with respect to new or many-sided workpiece geometries, consequently more rapid changeover in the production for different workpieces
- Reduction of the supports necessary for different workpieces, for similar workpieces exposure may be done by adjusting the modulation with equal supports.
- One may for specific more simple workpieces (not too steep lateral faces) avoid the use of rotating supports, which, on one hand results in simpler and less costly supports and, on the other hand, eliminates a loss of throughput resulting from rotating supports.

What is claimed is:

1. Apparatus for exposing substrates to UV radiation within an application-area, whereby the apparatus comprises:

- a radiation source which comprises a reflector and emits a diverging direct radiation that comprises UV radiation as well as visible light ("VIS") and infrared radiation ("IR") in a spatial angle; and
- a radiation selective deflecting mirror which reflects most part of the UV radiation and transmits most part of the VIS & IR radiation, wherein the deflecting mirror comprises at least two flat mirror strips, each having two longer edges and two shorter edges, wherein each of the at least two flat mirror strips has its own axis parallel to a longer edge of said flat mirror strip, wherein each of the at least two flat mirror strips is configured to rotate around its own axis and relative to each other in such a manner that a combination of the at least two flat mirror strips forms a concave surface and the at least two flat mirror strips reflect the diverging direct radiation from the radiation source in direction to the application-area and thereby at least reduce the divergence and consequently lead to an increase of a surface intensity of the UV radiation in the application-area, and wherein the apparatus comprises a support including a plurality of fixation elements arranged on the two shorter edges of each of the at least two flat mirror strips, wherein two fixation elements of neighboring mirror strips are linked by a joint, the support being configured to twist an inclination of each of the at least two flat mirror strips at a certain angle range about each respective axis of each of the at least two flat mirror strips.

2. Apparatus according to claim 1 characterized by the fact that the deflecting mirror comprises three flat mirror strips.

3. A method for manufacturing an apparatus for exposing substrates to UV radiation within an application-area, said method comprising the following steps:

providing a radiation source which comprises a reflector and emits a diverging direct radiation that comprises UV radiation as well as visible light ("VIS") and infrared radiation ("IR") in a spatial angle;

coating at least one flat glass plate with an interference filter which is based on thin film layer systems, whereby the interference filter, for a predetermined impinging angle, reflects UV radiation and transmits VIS & IR radiation;

dissecting the at least one flat glass plate in strips subsequent to the coating, each strip having two longer edges and two shorter edges, wherein the two longer edges are parallel to an axis;

mounting at least two strips in a mutually inclined manner around the axis and relative to each other on a support, whereby the at least two strips reflect the diverging direct radiation from the radiation source in a direction to the application-area and thereby at least reduce the divergence and consequently lead to an increase of a surface intensity of the UV radiation in the application-area; and providing a deflecting mirror comprising the at least one flat glass plate and the at least two mutually inclined strips, wherein the deflecting mirror reflects most part of the UV radiation and transmits most part of the VIS & IR radiation.

4. The method according to claim 3, wherein each of the at least two strips is coated with a different interference filter optimized for a specific angle.

5. The apparatus according to claim 1 characterized by the fact that the deflecting mirror comprises exactly three strips.

6. The apparatus according to claim 5, wherein the exactly three strips are inclined relative to each other.

7. The apparatus according to claim 5, wherein the deflecting mirror is concave and the exactly three strips are inclined relative to each other such that the exactly three strips form a concave curvature.

8. The method according to claim 3, wherein the support is tailored so that each of the at least two mirror strips is oriented at a pre-determined angle relative to a main optical path of the UV radiation.

9. The method according to claim 3, wherein each of the at least two mirror strips is fixed to the support such that each of the at least two mirror strips is configured to be twisted at a certain angle range about the axis.

10. The method according to claim 3, wherein each of the at least two mirror strips is fixed to the support via fixation elements provided along shorter edges of the at least two mirror strips.

11. The method according to claim 10, wherein two outermost strips of the at least two mirror strips are fixed to the support via additional fixation elements fixed to circular arcs.

12. The apparatus according to claim 1, wherein the deflecting mirror comprises strips of differently coated glass plates.

13. The apparatus according to claim 1, wherein each of the at least two flat mirror strips comprises a thin film mirror layer with an individual spectral characteristic.

* * * * *